US011090790B2

(12) United States Patent
Theberath et al.

(10) Patent No.: US 11,090,790 B2
(45) Date of Patent: Aug. 17, 2021

(54) PNEUMATIC NAILER WITH SINGLE AND CONTACT TRIGGERING

(71) Applicant: Joh. Friedrich Behrens AG, Ahrensburg (DE)

(72) Inventors: Martin Theberath, Tangstedt (DE); Joachim Bauer, Bad Oldesloe (DE)

(73) Assignee: Joh. Friedrich Behrens AGAhrensburg

( * ) Notice: Subject to any disclaimer, the term of this patent is extended or adjusted under 35 U.S.C. 154(b) by 57 days.

(21) Appl. No.: 16/309,510

(22) PCT Filed: Jun. 6, 2017

(86) PCT No.: PCT/EP2017/063658

§ 371 (c)(1),
(2) Date: Dec. 13, 2018

(87) PCT Pub. No.: WO2017/215977

PCT Pub. Date: Dec. 21, 2017

(65) Prior Publication Data

US 2019/0176312 A1 Jun. 13, 2019

(30) Foreign Application Priority Data

Jun. 15, 2016 (EP) ..... 16174539

(51) Int. Cl.
*B25C 1/00* (2006.01)
*B25C 1/04* (2006.01)

(52) U.S. Cl.
CPC ..... *B25C 1/008* (2013.01); *B25C 1/047* (2013.01)

(58) Field of Classification Search
CPC ..... B25C 1/04
(Continued)

(56) References Cited

U.S. PATENT DOCUMENTS 3,685,396 A * 8/1972 Obergfell ..... B25C 1/041 91/356
4,509,668 A 4/1985 Klais et al.
(Continued)

FOREIGN PATENT DOCUMENTS

DE 3142237 A1 5/1983
DE 9216386 U1 2/1993
(Continued)

OTHER PUBLICATIONS

PCT/EP2017/063658, filed Jun. 6, 2017; Translation of International Preliminary Report on Patentability, dated Dec. 20, 2018, Joh. Friedrich Behrens AG, (6 pages).
(Continued)

*Primary Examiner* — Nathaniel C Chukwurah
(74) *Attorney, Agent, or Firm* — Barclay Damon LLP

(57) ABSTRACT

A pneumatic nailer comprises a working piston connected to a driving plunger that is configured for driving in a fastener, a triggering device, and a switching device. The triggering device comprises a manually-operated trigger, a contact sensor, and a force-transmitting device configured to control a control valve. The control valve triggers the driving process in single triggering mode resulting from an actuation of the trigger when the contact sensor is actuated. The switching device has a first position, a second position, and a control piston that is configured to move between the first position and the second position. The switching device is configured to change the force-transmitting device from a contact triggering mode to a contact triggering position. In contact triggering position, the force-transmitting device is configured to control the control valve when the trigger is actuated as a result of the actuation of the contact sensor.

14 Claims, 14 Drawing Sheets

(58) Field of Classification Search
USPC ..... 173/169, 90, 213, 46, 47; 227/8, 130, 227/131, 132
See application file for complete search history.

(56) References Cited

U.S. PATENT DOCUMENTS

| | | | | |
|---|---|---|---|---|
| 5,370,037 | A | 12/1994 | Bauer et al. | |
| 5,522,532 | A * | 6/1996 | Chen | B25C 1/008 227/130 |
| 2005/0023318 | A1 | 2/2005 | Aguirre et al. | |
| 2014/0231485 | A1 * | 8/2014 | Bauer | B25C 1/04 227/8 |
| 2016/0153728 | A1 | 6/2016 | Rolle et al. | |

FOREIGN PATENT DOCUMENTS

| | | | |
|---|---|---|---|
| DE | 102013106657 | A1 | 1/2015 |
| EP | 2161103 | A1 | 3/2010 |
| EP | 2767365 | A1 | 8/2014 |
| JP | 2002346946 | A | 12/2002 |
| JP | 4219101 | A | 2/2003 |
| WO | 2016/026560 | A | 2/2016 |

OTHER PUBLICATIONS

Joh. Friedrich Behrens AG; JP20180564795; filed Jun. 6, 2017; Official Notification of Reasons of Refusal; dated Sep. 17, 2020; (3 pages).

Joh. Friedrich Behrens AG; JP20180564795; filed Jun. 6, 2017; English Translation of Official Notification of Reasons of Refusal; dated Sep. 17, 2020; (3 pages).

* cited by examiner

PNEUMATIC NAILER WITH SINGLE AND CONTACT TRIGGERING

CROSS REFERENCE TO RELATED INVENTION

This application is a national stage application pursuant to 35 U.S.C. § 371 of International Application No. PCT/EP2017/063658, filed on Jun. 6, 2017, which claims priority to, and benefit of, European Patent Application No. 16 174 539.3, filed Jun. 15, 2016, the entire contents of which are hereby incorporated by reference.

BACKGROUND

The invention relates to a pneumatic nailer with a working piston which is connected to a driving plunger for driving in a fastener, and which is contacted by compressed air when a driving process is triggered, with a triggering device that has a manually-operated trigger, a contact sensor, and a force-transmitting device which controls a control valve that triggers a driving process in single triggering mode resulting from an actuation of the trigger when the contact sensor is actuated.

The contact sensor is a mechanical component which is usually held by a spring in a position projecting beyond an aperture tool of the pneumatic nailer. If the pneumatic nailer is placed on a workpiece, the contact sensor is displaced against the force of the spring until the aperture tool lies on, or nearly on, the workpiece. A driving process can only be triggered when the contact sensor is actuated in this manner. Consequently, the known pneumatic nailers offer significantly improved safety against unintentional triggering in comparison to devices without a contact sensor.

Some pneumatic nailers with a triggering device of the described kind can be used in two different modes. With so-called single triggering, the pneumatic nailer is first placed on a tool which actuates the contact sensor. Then the trigger is actuated manually, and an individual driving process is triggered.

With so-called contact triggering, also termed "touching", the user pulls the trigger while placing the pneumatic nailer on the workpiece. While being set on the workpiece, the contact sensor is actuated and thereby triggers a driving process. The pneumatic nailer can be repeatedly set in rapid sequence which enables very rapid work, especially when many fasteners must be driven in for sufficient fastening, and only modest requirements are placed on the precision of their positioning.

In certain situations, there is an increased risk of injury associated with the contact triggering method. If for example the user pulls the manually actuated trigger not just when he wants to set the pneumatic nailer on the same workpiece at a distance of a few centimeters from the last driven fastener, but also when he switches to another workpiece arranged at a distance, a driving process can be triggered upon unintentionally touching an object or body part with the contact sensor. For example, accidents can occur when a user (while not observing important safety guidelines) climbs a ladder with the pneumatic nailer while pulling the trigger, and the contact sensor accidentally brushes against his leg.

A pneumatic nailer is disclosed in JP 2002 346946 A with a trigger and a contact sensor. If the contact sensor is first actuated and then the trigger, contact triggering mode is activated, and fasteners can be driven in by sequentially actuating the contact sensor until the trigger is released. If the trigger is first actuated and then the contact sensor, single triggering mode is active, and another driving process can only be triggered if the trigger has been released beforehand. The document US 2005/0023318 A1 discloses a pneumatic nailer with the same function. With both known pneumatic nailers, using single triggering mode can prevent a second fastener from being driven in unintentionally after a single driving process. However, the above-outlined risk of injury still exists.

A pneumatic nailer is disclosed in EP 2 767 365 A1 which has a triggering device with a trigger, a contact sensor, and a force-transmitting device. In single triggering mode, the force-transmitting device controls a control valve which triggers a driving process resulting from an actuation of the trigger when the contact sensor is actuated. As an additional safety measure, the known pneumatic nailer has a safety control chamber, the pressure of which acts on a blocking piston which prevents a driving process from being triggered when the blocking piston is in a certain position. After the trigger is actuated, contact triggering is only possible for a short time, i.e., until the pressure passes a set threshold in the safety control chamber. Then the pneumatic nailer is blocked until the trigger is released and the pressure in the safety control chamber again reaches its initial state.

Against this background, it is the object of the invention to provide a pneumatic nailer with an improved safety mechanism.

BRIEF SUMMARY OF THE INVENTION

This object is achieved by the pneumatic nailer with the features of claim 1. Advantageous embodiments are presented in the subsequent dependent claims.

The pneumatic nailer has:

a working piston which is connected to a driving plunger for driving in a fastener, and which is contacted by compressed air when a driving process is triggered, a triggering device that has a manually-operated trigger, a contact sensor, and a force-transmitting device which controls a control valve that triggers a driving process in single triggering mode resulting from an actuation of the trigger when the contact sensor is actuated, and a switching device which can change the force-transmitting device for contact triggering mode into contact triggering position in which the force-transmitting device controls the control valve when the trigger is actuated as a result of the actuation of the contact sensor.

The pneumatic nailer is used for driving in fasteners such as nails, pins or staples. For this purpose, the pneumatic nailer can have a magazine for the fasteners from which one fastener is supplied in each case to a seat of an aperture tool of the pneumatic nailer. When a driving process is triggered, compressed air is applied to a working piston of the pneumatic nailer. The working piston propels a driving plunger that is connected to the working piston. The driving plunger contacts a rear end of the fastener in the seat of the aperture tool and drives the fastener into the workpiece.

The triggering device has a manually actuatable trigger, such as in the form of a toggle switch or sliding switch, and a contact sensor. The contact sensor can be a mechanical component which projects beyond the front end of the aperture tool and is held in this position by a spring until the pneumatic nailer is placed on a workpiece. Then the contact sensor is moved opposite the direction of the spring force and opposite the driving direction.

The trigger and contact sensor act via a force transmission device on a control valve, the control of which triggers a driving process. To control the control valve, a control pin of the control valve can in particular be moved by the force-transmitting device. For this, joint actuation of the trigger and contact sensor is required. If only either the manually actuated trigger or the contact sensor is actuated, the first control valve is not controlled. In so-called single triggering mode, a driving process is moreover only triggered when the trigger is actuated while the contact sensor is actuated. First the contact sensor and then the trigger must be actuated.

As long as the pneumatic nailer is in an initial state such as after turning on the pneumatic nailer (for example by connecting the pneumatic nailer to a compressed air source) or after a break, it is in principle impossible to trigger a driving process by first actuating the trigger and then, while the trigger is actuated, actuating the contact sensor.

To enable such contact triggering, the pneumatic nailer according to the invention has a switching device, however, by means of which the force-transmitting device can be moved into a contact triggering position for contact triggering mode. In contrast to the initial state, the force-transmitting device in this contact triggering position can control the control valve by then actuating the contact sensor, even when the trigger is actuated.

The pneumatic nailer therefore offers optimum operating safety since it in principle only permits single triggering mode. Contact triggering mode can only be switched to with the assistance of the switching device which acts on the force-transmitting device.

The switching device has a first position assigned to single triggering mode, and a second position assigned to contact triggering mode, wherein the switching device is moved into the second position when a driving process is triggered. If the switching device is in the first position, only the aforementioned single triggering mode is possible. If it is in the second position, it can move the force-transmitting device into the contact triggering position, and/or keep it in this contact triggering position. By moving the switching device into the second position when triggering a driving process, contact triggering mode is switched to once a (first) driving process has been triggered. It is in particular possible to drive in other fasteners in contact triggering mode after a first driving process is performed by single triggering. This simplifies in particular driving a plurality of fasteners in rapid sequence into the same workpiece but, however, does not cause a significant impairment of job safety since sequential contact triggerings are only possible after a single triggering has been performed beforehand.

In one embodiment, the switching device has a time control so that the switching device (automatically) returns from the second position into the first position after expiration of a set time if a driving process is not triggered. The set time can, for example, lie within a range of 1 second to 10 seconds. The cited measure makes contact triggerings impossible after a short break, for example when switching to a different workpiece. Instead, a single triggering must be performed first after expiration of the set time.

There are in principle numerous possibilities for the design of the switching device and time control including mechanical, electromechanical or electronic solutions. In the invention, the switching device has a control piston which can move between the first position and the second position and is designed to move the force-transmitting device into the contact triggering position, or hold it in the contact triggering position. Using a control piston for the switching device enables in particular a pneumatic solution which can be particularly space-saving and reliable.

The control piston is guided in a control cylinder which has a control volume, wherein the control piston is moved into the first position when a set pressure in the control volume is undershot or exceeded. The switching device is accordingly returned to the first position based on the pressure in the control volume. In addition, spring force can be applied to the control piston, in particular in a direction opposite the direction of force exerted by the pressure.

The control volume is filled with air or vented upon triggering a driving process. "Filled with air" always means that a connection is established to a chamber that conducts compressed air. "Vented" always means that a connection is established to a depressurized space, in particular to outside air. The control valve is responsible for venting the control volume or filling it with air. Accordingly upon each actuation of the control valve, a driving process is triggered, and compressed air is conducted by the control valve into the control volume, or compressed air can escape from the control volume via the control valve. The desired change in pressure in the control volume is thereby brought about very quickly and directly by the control valve. One advantage of supplying air to or venting the control volume by the control valve is that the essential control processes including controlling the switching device are combined in a small space and can be accomplished independently with relatively little compressed air consumption, or respectively decoupled from the driving process. Depending on the configuration of the acting direction of the control piston, the control piston is moved into the second position either by filling with air or ventilation.

In one embodiment, the control volume is filled with air by a check valve. This filling the control volume with air causes the control piston to move into the second position. By using a check valve, the pressure in the control volume is initially retained after being filled with air, in particular when the control valve is used for filling the control valve with air and the control valve is moved into a noncontrolled position after the driving process.

In one embodiment, the time control has a throttle which is connected to the control volume. Depending on the operating direction, the control volume can be connected via the throttle to the housing interior under pressure, or to outside air, or connected thereto by controlling a valve. For example, in one embodiment in which the control volume is filled with air to move the control piston into the second position, the control volume is connected via the throttle to outside air. Then the air located in the control volume escapes outward via the throttle each time the control volume is filled with air, i.e., after each driving process. If a set pressure threshold is undershot, the control piston returns to its first position, in particular by the force of a spring.

In one embodiment, the force-transmitting device has a movably mounted force transmitting element with a switching surface to actuate the control valve, wherein the force transmitting element is arranged in the contact triggering position of the force-transmitting device such that it is entrained by a catch connected to the contact sensor and executes a movement in a triggering direction. This creates a simple approach for contact triggering starting from the contact triggering position.

In one embodiment, the switching device is configured to limit a movement in the second position of the force transmitting element contrary to the triggering direction. In this manner, the switching device can in particular prevent the force transmitting element from returning from the contact triggering position contrary to the triggering direction into an initial position in which contact triggering is impossible. The force transmitting element, or respectively the force-transmitting device, can in particular be held in the contact triggering position.

In one embodiment, the force transmitting element is a rocker pivotably mounted in the trigger on a pivot shaft with a switching surface, and the movement is a pivoting movement on the pivot shaft. In principle, the force transmitting element can execute both a translatory movement as well as a rotating movement, or a combination of both. The use of a rocker with a pivot shaft is a particularly robust and simple solution. The switching surface of the rocker is the section which is designed to control the control valve.

In one embodiment, the control piston has a piston rod which, in the second position of the control piston, can lie against a control surface of the rocker opposite the switching surface of the rocker with respect to a pivot shaft of the rocker. This allows the piston rod to limit the movement of the rocker contrary to the triggering direction.

In one embodiment, the control piston has a piston rod which is guided through an opening in the rocker so that the piston rod can pull the rocker toward the piston rod. The opening is in particular located on the same side of the pivot shaft as the rocker switching surface. By moving the rocker with the piston rod, a movement of the rocker contrary to the triggering direction can also be limited.

In one embodiment, the control valve and control piston are combined in a valve block. If applicable, the choke can also be integrated in the valve block. This yields a particularly compact arrangement. The valve block is in particular arranged above the trigger.

In one embodiment, a pneumatic connection between the control valve and the control volume, through which the control volume is filled with air or vented by the control valve, has an overall volume which is less than the control volume. In particular, the pneumatic connection can consist of a single line which leads from the control valve to the control volume, for example from a hole with a relatively small diameter or with a relatively small length. This embodiment promotes high pneumatic nailer efficiency because the compressed air consumption for the required change in pressure in the control volume is slight. In addition, the installation space available in the pneumatic nailer as a pressure accumulator is only significantly reduced due to the small overall volume of the pneumatic connection.

In one embodiment, the pneumatic connection is arranged within the valve block.

This enables a particularly compact pneumatic nailer design.

In one embodiment, the size of the control volume is at most 5% of the size of a working volume of a working cylinder in which the working piston is guided.

BRIEF DESCRIPTION OF THE DRAWINGS

The invention is explained in greater detail below based on two exemplary embodiments shown in figures. In the following.

DETAILED DESCRIPTION OF THE INVENTION

Figure 1:
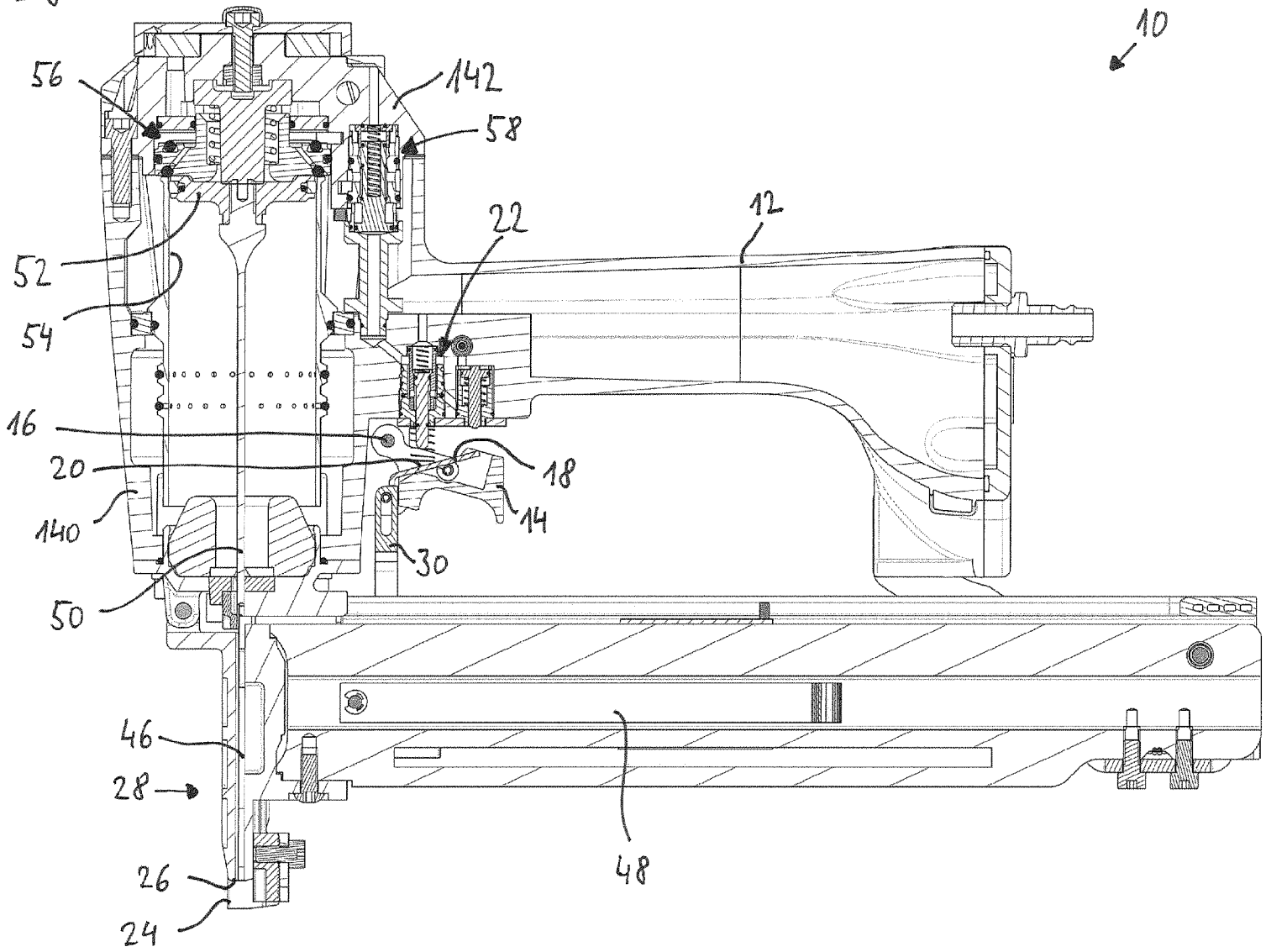
FIG. 1 shows a first exemplary embodiment of a pneumatic nailer according to the invention in a partially cut away representation.

Initially, a few elements of the pneumatic nailer 10 will be described, some summarily, with reference to FIG. 1. The pneumatic nailer 10 has a bottom housing part 140 with a handle 12. The bottom housing part 140 is sealed at the top by a housing cap 142.

The manually actuated trigger 14 is pivotably mounted on a pivot shaft 16 to the housing of the pneumatic nailer 10 and arranged such that it can be actuated with the index finger by a user who holds the pneumatic nailer 10 by the handle 12. Moreover, there is a contact sensor 24 that projects downward a few millimeters beyond the aperture 26 of an aperture tool 28. If the pneumatic nailer 10 is placed on a workpiece, the contact sensor 24 is moved upward against the force of a spring (not shown) until it abuts the aperture 26 flush, or nearly flush.

In addition to the trigger 14 and the contact sensor 24, the trigger device of the pneumatic nailer 10 comprises a force-transmitting device which has a slider 30 and a force transmitting element in the form of a rocker 18. The slider 30 is a continuation of the contact sensor 24, or is connected to the contact sensor 24. It always moves together with the contact sensor 24 and in particular follows its movement upward relative to the housing when the pneumatic nailer 10 is placed on a workpiece. The rocker 18 has a switching surface 20 by means of which a control valve 22 that is arranged above the trigger 14 can be controlled.

The aperture tool 28 has a seat 46 which is supplied a fastener from a magazine 48. From this position within the seat 46, the fastener such as a nail, pin or staple is driven by a driving plunger 50 which is connected to a working piston 52 of the pneumatic nailer 10. In this context, the working piston 52 is guided in a working cylinder 54. A main valve 56 is arranged above the working cylinder 54 and seals it; to the right is arranged a pilot valve 58 which controls the main valve 56. Details of these elements as well as the associated function of the device will be explained with reference to the enlargement of a section in FIG. 2.

Figure 2:
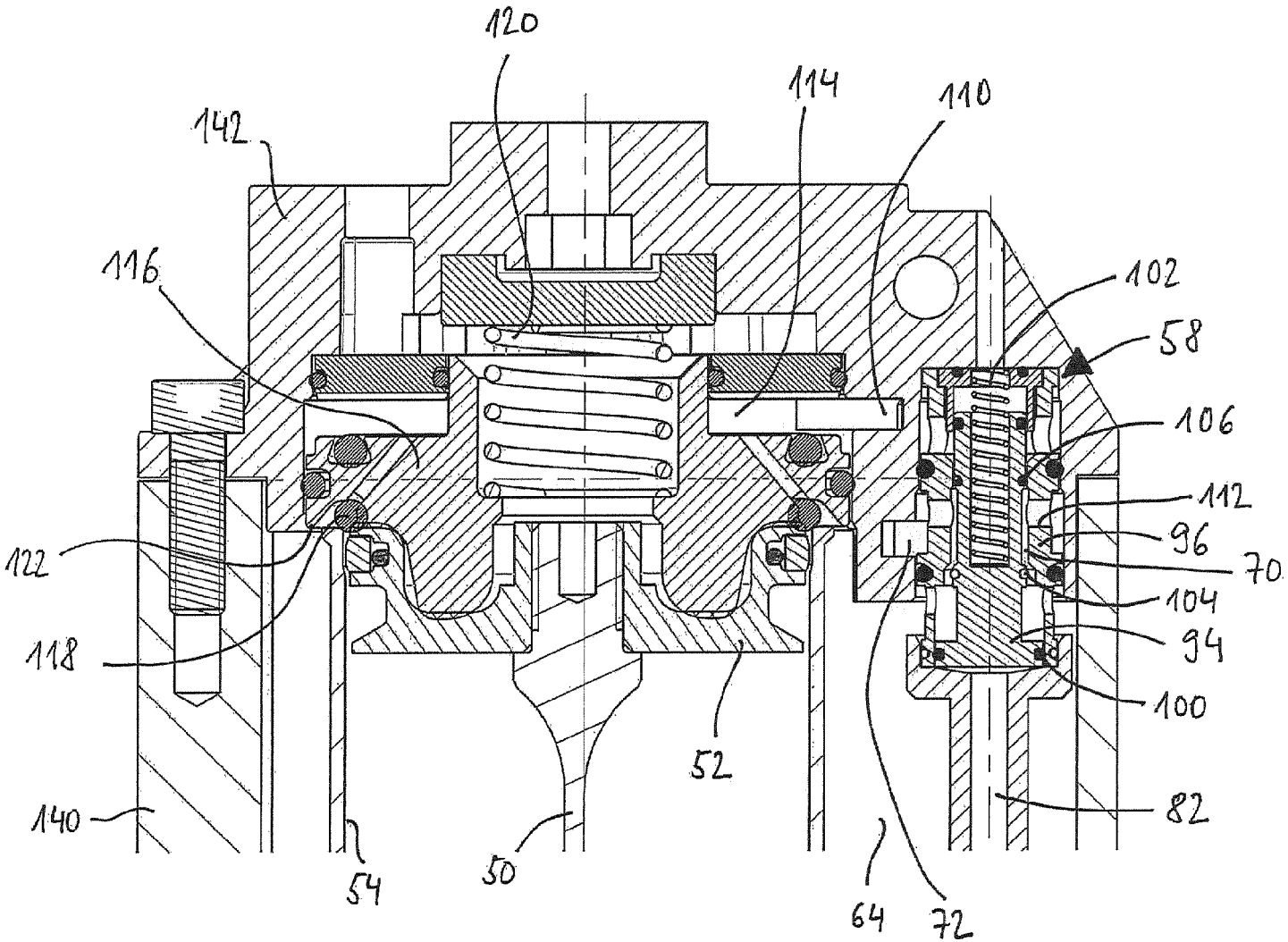
FIG. 2 shows an enlarged view of a section with the main valve and pilot valve from FIG. 1.

In FIG. 2, individual elements of the pneumatic nailer 10 which are arranged above the housing cap 142 in FIG. 1 are omitted. The pilot valve 58 is easily discernible. It has a control piston 94 which is guided in a guide sleeve 96. The bottom end of the control piston 94 is sealed against the guide sleeve 96 by a bottom O-ring 100. In the initial state of the pneumatic nailer 10, a first control line 82 which is connected to a working volume of the pilot valve 58 is vented, and the control piston 94 is located in the shown bottom position. In this position, it is held by the force of a spring 102.

In addition to the bottom O-ring 100, the control piston 94 has a middle O-ring 104 and a top O-ring 106. In the depicted bottom position of the control piston 94, the top O-ring 106 seals the control piston 94 against the guide sleeve 96, and closes a connection to a vent hole (not shown) connected to the outside air. The middle O-ring 104 is not sealed, so that a main control line 110 is connected to the housing interior 64 via a radial hole 112 in the guide sleeve 96 and the annular gap 70 between the control piston 94 and guide sleeve 96 running past the middle O-ring 104. The main control line 110 is connected via a connection, which is invisible in the depicted sectional plane, to the chamber 72 that terminates in the radial hole 112. In the initial state of the pneumatic nailer 10, the housing interior 64 is filled with air, i.e., by a compressed air connection (not shown), and is under operating pressure.

The main control line 110 is connected to a chamber 114 above a main valve actuator 116 of the main valve 56 such that the main valve actuator 116 is pressed with a downward force which seals the top edge of the work cylinder 54 by means of an O-ring 118 against the housing interior 64. In addition, the main valve actuator 116 is pressed by a spring 120 with a force toward the shown position that seals the work cylinder 54.

A driving process is triggered by filling the first control line 82 with air in that the control piston 94 is moved upward so that the O-ring 104 creates a seal, and the top O-ring 106 releases the seal. This blocks the connection of the main control line 110 to the housing interior 64, and a connection between the main control line 110 and a vent opening (not shown) is established. The chamber 114 above the main valve actuator 116 is vented through the vent opening, and the main valve actuator 116 is moved upward by the pressure at its bottom, outer annular surface 122 predominating in the housing interior 64 against the pressure of the spring 120. This causes compressed air to flow out of the housing interior 64 into the working cylinder 54 above the working piston 52 and drives the working piston downward 52. During this downward movement, the driving plunger 50 connected to the working piston 52 drives in a fastener.

Figure 3:
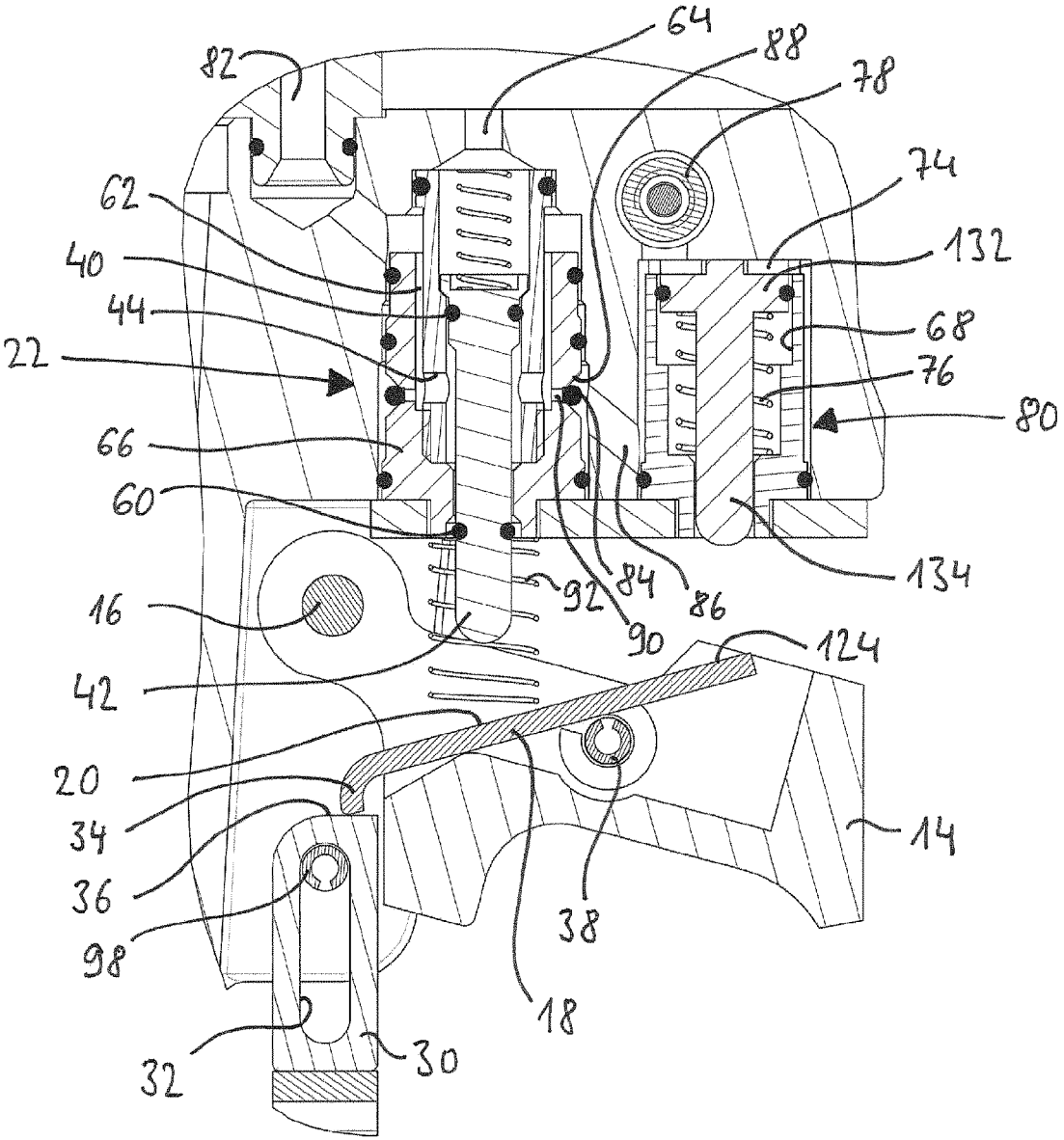
FIG. 3 shows an enlarged view or an initial state of the pneumatic nailer.

Details of the triggering device are better discernible in FIG. 3 which shows an initial state of the pneumatic nailer 10. The trigger 14 and contact sensor 24 are not actuated.

The slider 30 is movably guided on the housing of the pneumatic nailer 10 and has a slot 32 through which a guide pin 98 is guided.

The manually actuatable trigger 14, the rocker 18 which is pivotably mounted therein on a pivot shaft 38, and the switching surface 20 of the rocker 18 are also clearly discernible. The pivot shaft 38 is located in a middle section of the rocker 18. In the shown position, a front end 34 of the rocker 18 lies against a catch 36 formed by a top end of the slider 30. The switching surface 20 is located between the front end 34 of the rocker 18 and the pivot shaft 38, or respectively the middle section of the rocker 18. When the contact sensor 24 is actuated upward out of the shown position, the catch 36 entrains the front end of the rocker 34 so that the rocker 18 executes a pivoting movement in a triggering direction.

Under certain conditions which will be explained in detail in conjunction with the other figures, the switching surface 20 of the rocker 18 controls the control valve 22 by moving a control pin 42 upward which triggers a driving process. The control pin 42 of the control valve 22 is guided in a sleeve 66 of the control valve 22 that is inserted in the housing against which it is sealed. A spring 92 is arranged around the control pin 42 and presses the trigger 14 and rocker 18 with a force against the triggering direction.

However, in the shown position of the control valve 22, a top O-ring 40 of the first control valve 22 seals the housing interior 64 against a radial hole 44 of the control valve 22, whereas the bottom O-ring 60 of the control valve 22 does not form a seal so that the radial hole 44 is connected to the outside air. The radial hole 44 is connected via an annular gap 62 to the first control line 82 so that the first control line 82 is also vented in the shown position of the control valve 22.

On the right in FIG. 3 next to the control valve 22, a switching device 80 is depicted that has a control piston 132 with a piston rod 134, the control piston 132 being guided in a control cylinder 68. A control volume 74 is located above the control piston 132. The pressure in the control volume 74 acts on a control piston 132 which is pressed in the opposite direction with the force of a spring 76. The control volume 74 is connected via a throttle 78 to outside air. On the side opposite the front end 34 of the rocker 18 with reference to the pivot shaft 38, the rocker 18 has a switching surface 124 which can interact with the piston rod 134.

The control valve 22 of the control piston 132 and the throttle 78 are combined into a valve block. The valve block is arranged above the trigger 14 in the housing of the pneumatic nailer 10.

There is another connection between the control volume 74 and the annular gap 62 of the control valve 22 via a check valve formed by an O-ring 84 and a hole 86 arranged obliquely. The O-ring 84 is seated in a peripheral rectangular groove 88 in the outside of the sleeve 66 and seals a radially arranged hole 90 in the sleeve 66. The function of this connection will be explained in conjunction with the other figures.

In the position in FIG. 3, the switching device 80, or respectively the control piston 132, is in a first position assigned to a single trigger mode. In this position, the piston rod 134 does not project, or only projects slightly, out of the housing.

Figure 4:
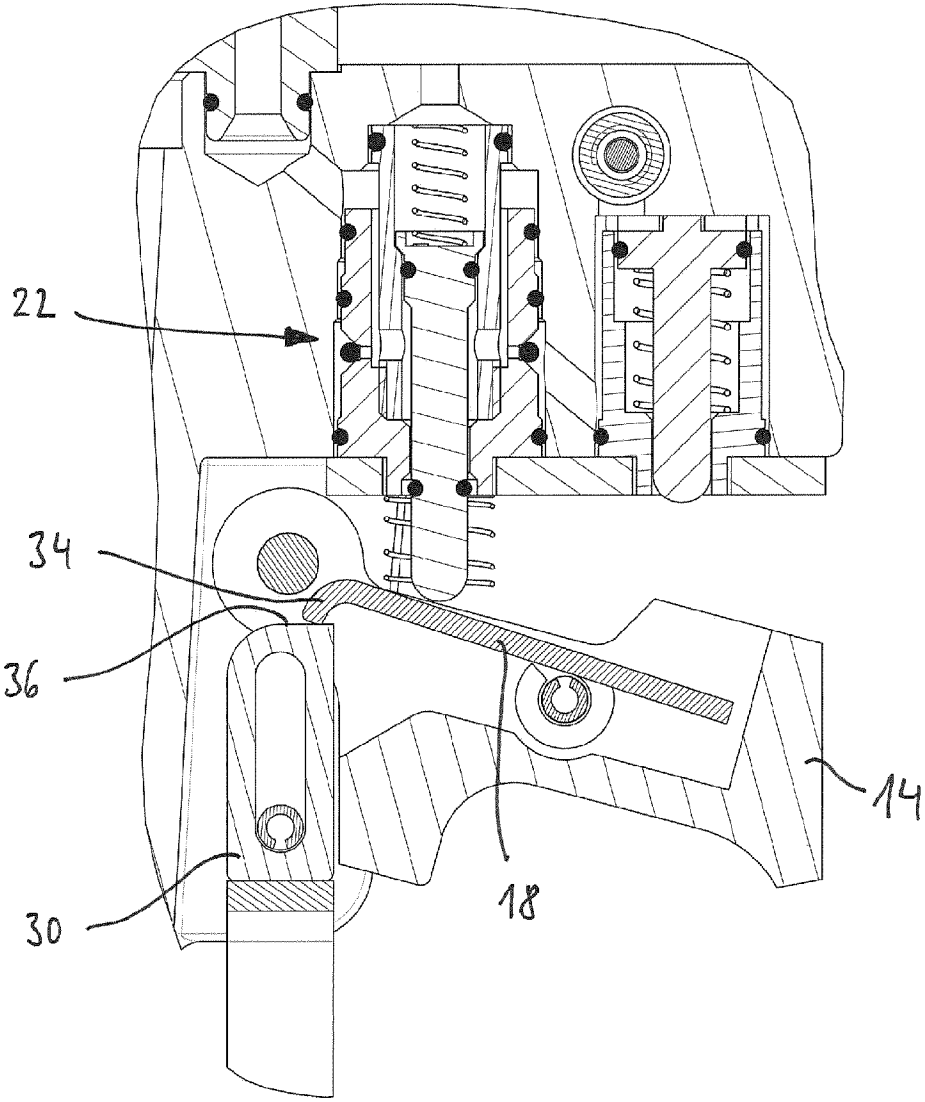
FIG. 4 shows the arrangement from FIG. 3 after a contact sensor has been actuated.

FIG. 4 shows the arrangement from FIG. 3 after the contact sensor 24 has been actuated. It can be seen that the catch 36 has entrained the front end 34 of the rocker 18 in the upward movement of the slider 30. This does not cause the control valve 22 to be controlled since the trigger 14 has not yet been actuated.

Figure 5:
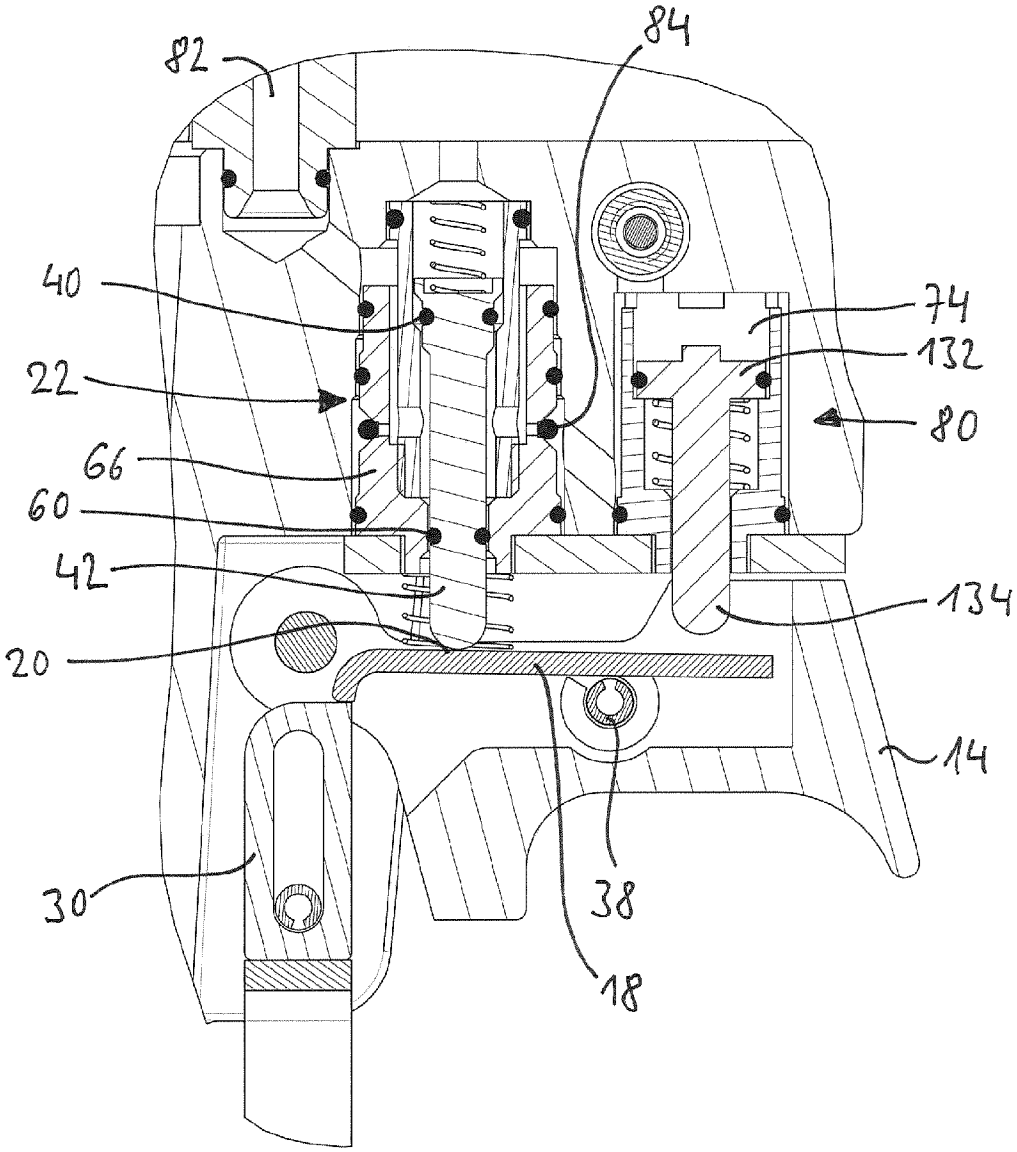
FIG. 5 shows the arrangement from FIG. 4 after the trigger has been actuated while the contact sensor is still actuated.

FIG. 5 shows the arrangement from FIG. 4 after the trigger 14 has been actuated while the contact sensor 24 is still actuated. In this step, the pivot shaft 38 moves upward relative to the position shown in FIG. 4, and the switching surface 20 of the rocker 18 controls the control valve 22 by moving the control pin 42 upward. This causes the upper O-ring 40 to unseal, and the lower O-ring 60 to seal against the sleeve 66. This causes of the first control line 82 to be filled with air through the above-described connection which triggers a driving process as explained in conjunction with FIG. 2.

At the same time, the control volume 74 of the switching device 80 is filled with air by the check valve formed by the O-ring 84, whereby the control piston 132 moves downward so that the piston rod 134 projects downward out of the housing of the pneumatic nailer 10. The switching device 80 is then located in a second position.

Figure 6:
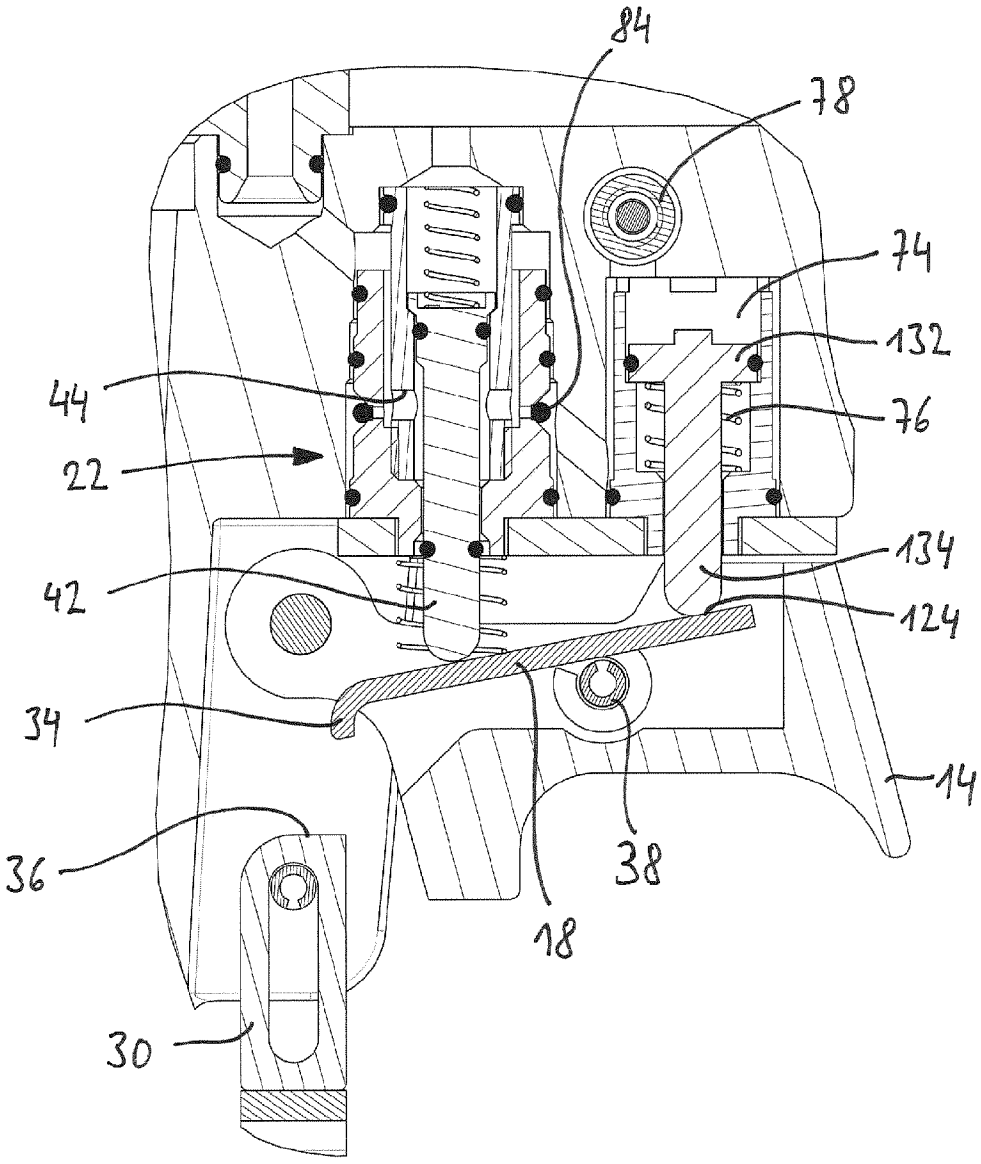
FIG. 6 shows the arrangement from FIG. 5 shortly after the pneumatic nailer has been removed from the workpiece which causes the contact sensor to return to its bottom initial position.

FIG. 6 shows the arrangement from FIG. 5 shortly after the pneumatic nailer 10 has been removed from the workpiece which causes the contact sensor 24 to return to its bottom initial position. The rocker 18 has consequently swung open slightly on the pivot shaft 38 contrary to the triggering direction while the trigger 14 remains actuated so that the control valve 22 is no longer controlled. The control pin 42 is again located in its bottom position as shown in FIG. 3.

The check valve formed by the O-ring 84 has blocked the connection between the control volume 74 and the radial hole 44 of the control valve 22 which is again connected to outside air as shown in FIG. 3 so that the pressure which has built up in the control volume 74 is slowly decreased through the throttle 78. At the time shown in FIG. 6, the pressure in the control volume 74 is still high enough for the control piston 132 to be held in its second position against the force of the spring 76.

When the trigger 14 is actuated, this causes the control surface 124 of the rocker 18 to lie against the piston rod 134, and a return movement of the rocker 18 about the pivot shaft 38 opposite the triggering direction is limited, and the rocker 18 remains in the drawn position. This position of the rocker 18 corresponds to a contact triggering position of the force-transmitting device. It can be seen that reactuating the contact sensor at the time shown in FIG. 6 leads to a contact triggering because the catch 36 entrains the front end 34 of the rocker 18 upward out of the drawn position. In this case, the control valve 22 is again controlled, and the pressure in the control volume 74 is raised to a pressure corresponding to the pressure in the housing interior 64 so that additional contact triggerings are subsequently possible.

Figure 7:
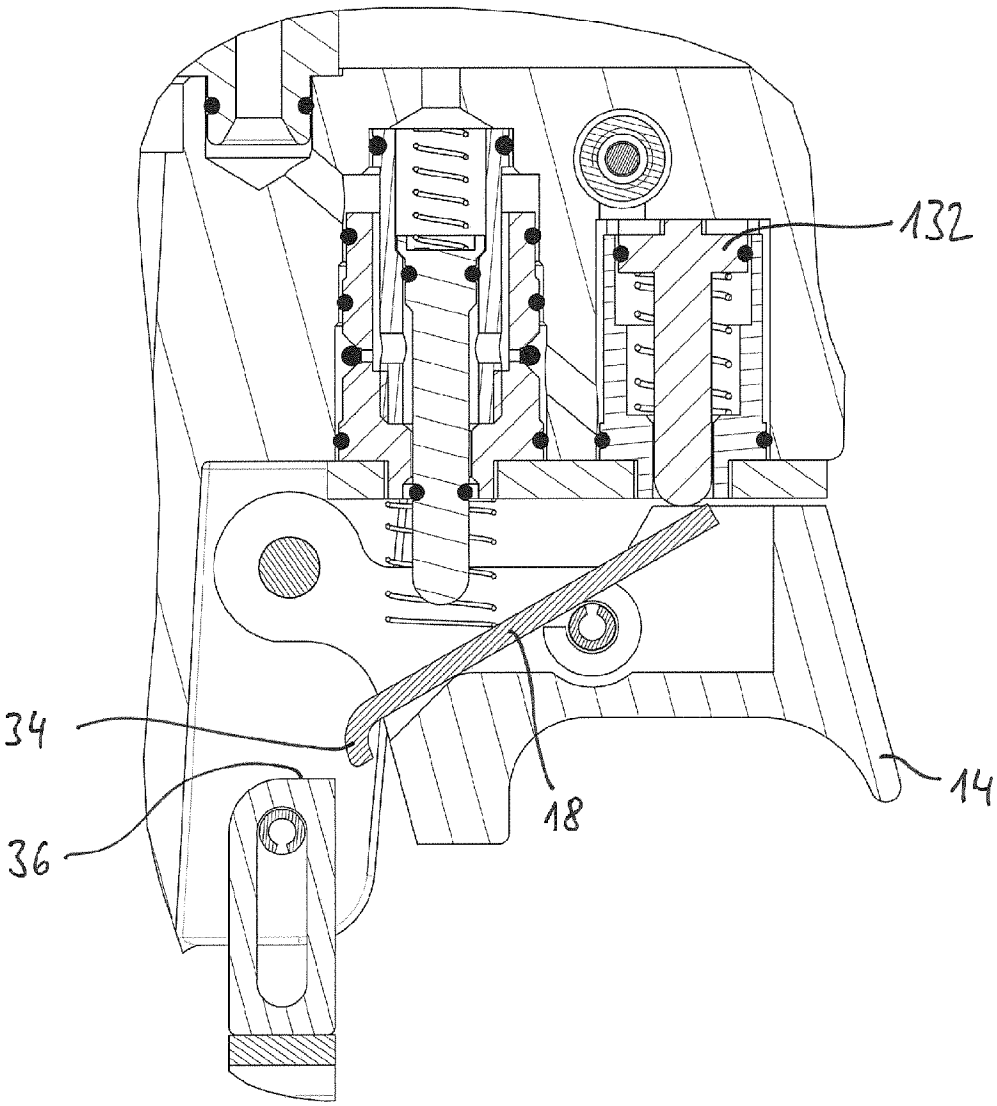
FIG. 7 shows the arrangement from FIG. 6 with the control piston in its first position.

This holds true until the pressure in the control volume 74 has been reduced sufficiently through the throttle 78 so that the control piston 132 returns to its first position. This is shown in FIG. 7. It can be seen that when the trigger 14 remains actuated, the rocker 18 is swung contrary to triggering direction relative to the position in FIG. 6. In this position, the front end 34 of the rocker 18 is at a lateral distance from the catch 36 so that it is not grabbed by the catch 36 when the contact sensor 24 is actuated.

Figure 8:
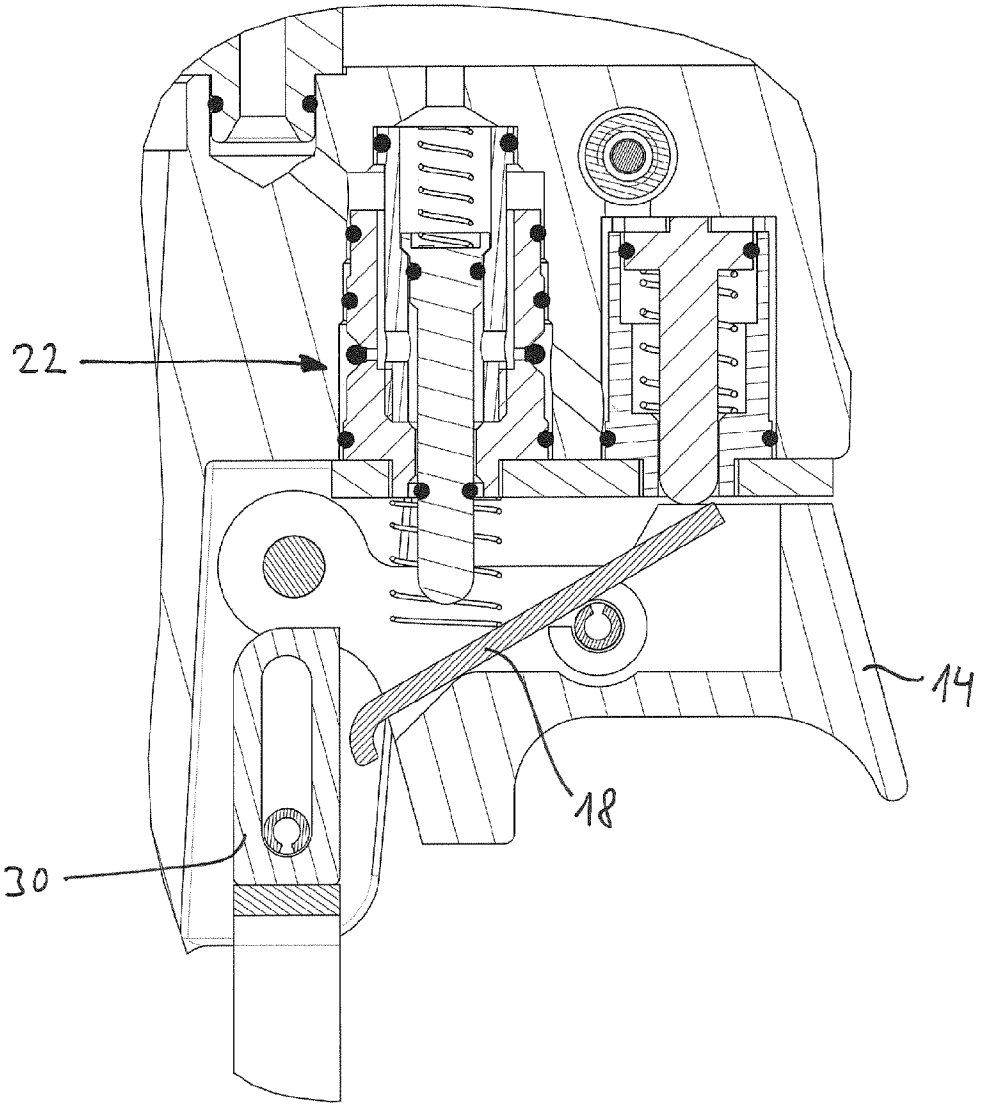
FIG. 8 shows the arrangement from FIG. 7 after actuation of the contact sensor.

Instead, actuating the contact sensor 24 leads to the situation in FIG. 8 starting from the position in FIG. 7. It can be seen that the control valve 22 is not controlled there despite the trigger 14 and contact sensor 24 being simultaneously actuated.

The second exemplary embodiment will be explained with reference to FIGS. 9 to 14. These figures only show a section of a pneumatic nailer 10 which corresponds to the depictions of the sections from FIGS. 3 to 8 of the first exemplary embodiment and that contains the elements that are different from the first exemplary embodiment. The other components of the pneumatic nailer 10 of the second exemplary embodiment are not re-shown. They correspond to the first exemplary embodiment as explained with reference to FIGS. 1 and 2. The same reference numbers are used for the elements that are changed in the second exemplary embodiment as for the elements of the first exemplary embodiment that are comparable in terms of their function.

Figure 9:
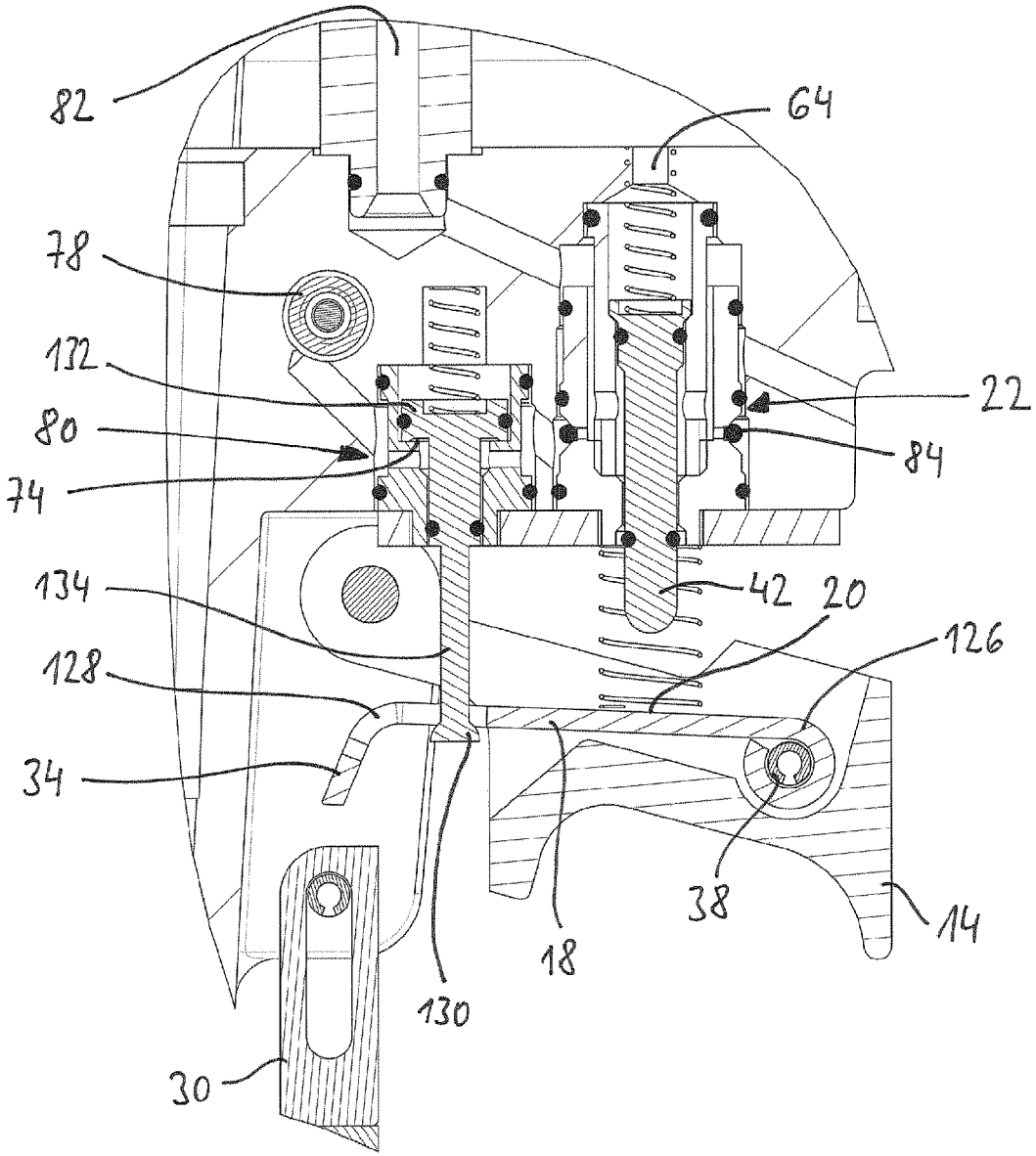
FIG. 9 shows an initial position of the pneumatic nailer with a trigger that is not actuated and contact sensor that is not actuated.

FIG. 9 shows an initial position of the pneumatic nailer 10 with a trigger is 14 that is not actuated and contact sensor 24 that is not actuated. In the second exemplary embodiment, the control valve 22 is on the right and the switching device 80 is on the left. The rocker 18 is also pivotable about a pivot shaft 38 in the trigger 14, however not in the middle but rather on a rear end 126 of the rocker 18. The switching surface 20 which interacts with the control pin 42 of the control valve 22 is located in the middle section of the rocker 18. The front end 34 of the rocker 18 is angled downward slightly more than in the first exemplary embodiment and moreover has a slotted opening 128 through which the piston rod 134 of the control piston 132 runs. The piston rod 134 has a head 130 that grips behind the edges of the slotted opening 128 so that the piston rod 134 can move the front end 34 of the rocker 18 upward toward the control piston 132. Different than in the first exemplary embodiment, the control volume 74 is located below the control piston 132 but is, however, connected to a throttle 78. In the initial position in FIG. 9, the control piston 132, or respectfully the switching device 80, is located in a first position.

With regard to the control valve 22 and the connections of the individual chambers of the control valve 22 to the housing interior 64 of the first control line 82 and the control volume 74 via a check valve formed by the O-ring 84, there are no changes from the first exemplary embodiments, with the exception of the partially deviating arrangement of the individual elements. The function of these elements will therefore not be reexplained. Contrastingly, a typical workflow will be described using the other figures.

Figure 10:
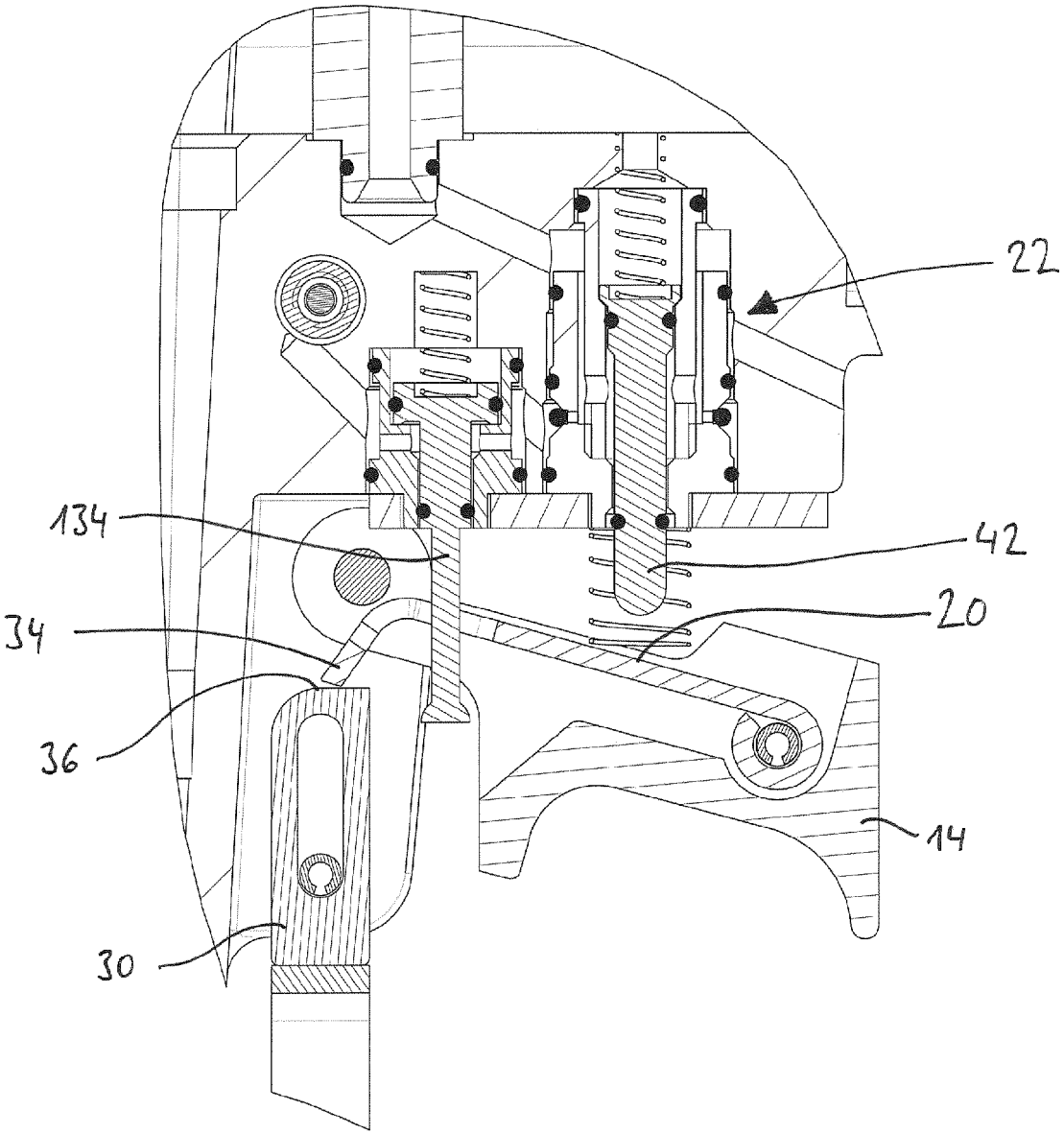
FIG. 10 shows the arrangement from FIG. 9 after the contact sensor has been actuated.

FIG. 10 shows the arrangement from FIG. 9 after the contact sensor 24 has been actuated. As in the first exemplary embodiment, the front end 34 of the rocker has also been lifted by the catch 36 of the slider 30 to produce the drawn position. The piston rod 134 does not restrict this upward movement of the rocker 18 since the slot 128 in the front end 34 of the rocker 18 is designed sufficiently large. Since the trigger 14 has not been actuated, the switching surface 20 is still located at a distance from the control pin 42, and the control valve 22 has not yet been controlled.

Figure 11:
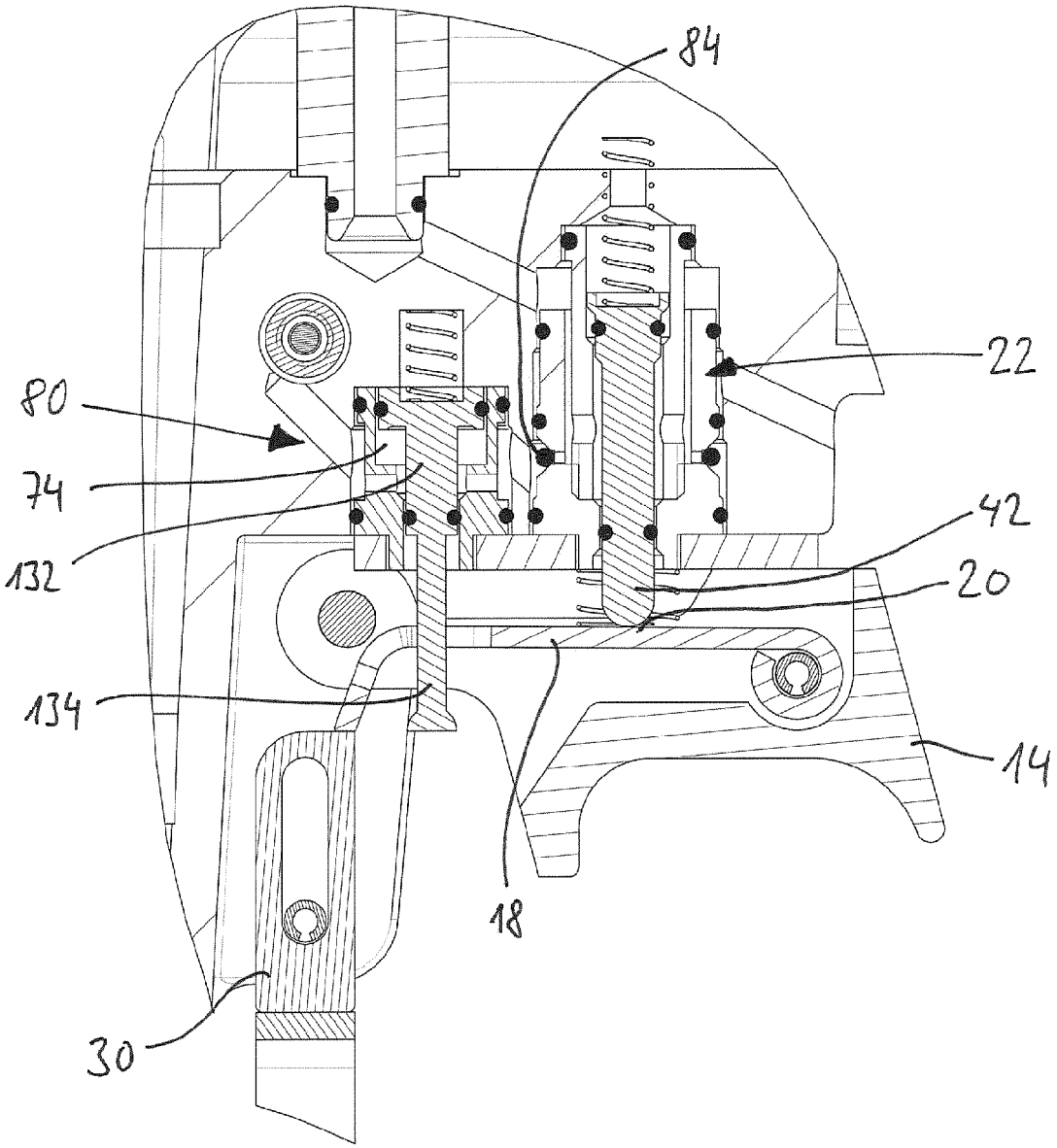
FIG. 11 shows the arrangement from FIG. 10 after the trigger has been actuated while the contact sensor is still actuated.

FIG. 11 shows the arrangement from FIG. 10 after the trigger 14 has been actuated while the contact sensor 24 is still actuated. This has already caused a single triggering since the switching surface 20 has moved the control pin 42 of the control valve 22 upward. At the same time, compressed air has been added to the control volume 74 by the check valve formed by the O-ring 84 so that the control piston 132 has moved upward with the piston rod 134 into a second position. This corresponds to the second position of the switching device 80.

Figure 12:
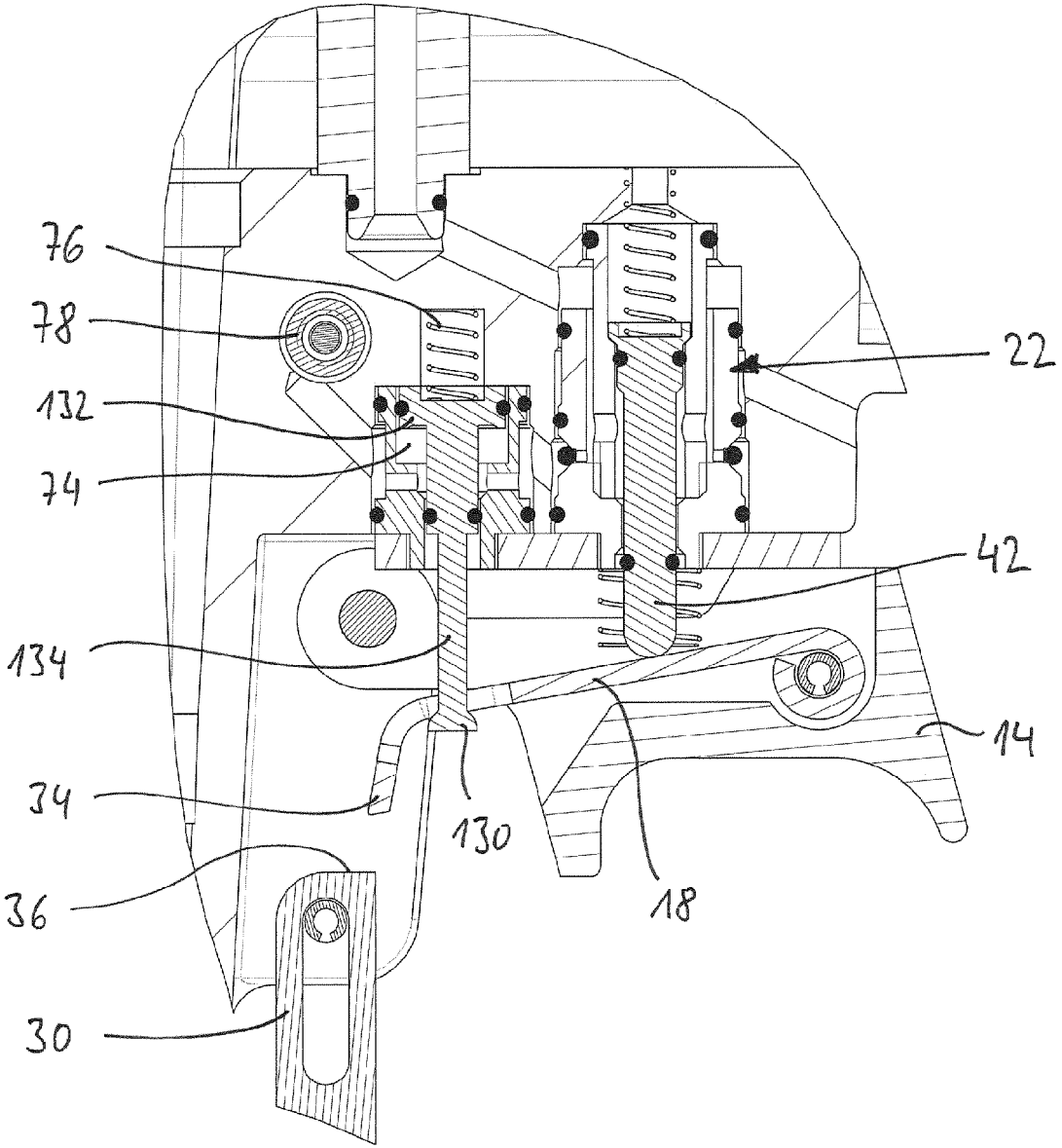
FIG. 12 shows a position of the pneumatic nailer where the contact sensor has moved downward with the slider.

After the pneumatic nailer 10 has been removed from the workpiece, the contact sensor 24 has moved downward with the slide 30 to bring about the position drawn in FIG. 12. It can be seen that the rocker 18 has swung back slightly contrary to the triggering direction so that the control pin 42 has moved back to its initial position, and the control valve 22 is no longer controlled. As in the first exemplary embodiment, the air now also escapes slowly via the throttle 78 from the control volume 74.

As long as the pressure in the control volume 74 is high enough for the control piston 132 to remain in the second position against the force of the spring 76, the head 130 of the piston rod 134 prevents the rocker 18 from moving further opposite the triggering direction than shown in FIG. 12. The front end 34 of the rocker 18 is therefore in a position in which it is captured by an upward movement of the catch 36 so that another control of the control valve 22 occurs. In FIG. 12, the rocker 18 is accordingly in a position which corresponds to the contact triggering position of the force-transmitting device.

Starting from the state in FIG. 12, the pressure in the control volume 74 slowly decreases as long as another driving process is not triggered. As the case may be, the control piston 132 returns to its first position shown in FIG. 9 after the expiration of a set time.

Figure 13:
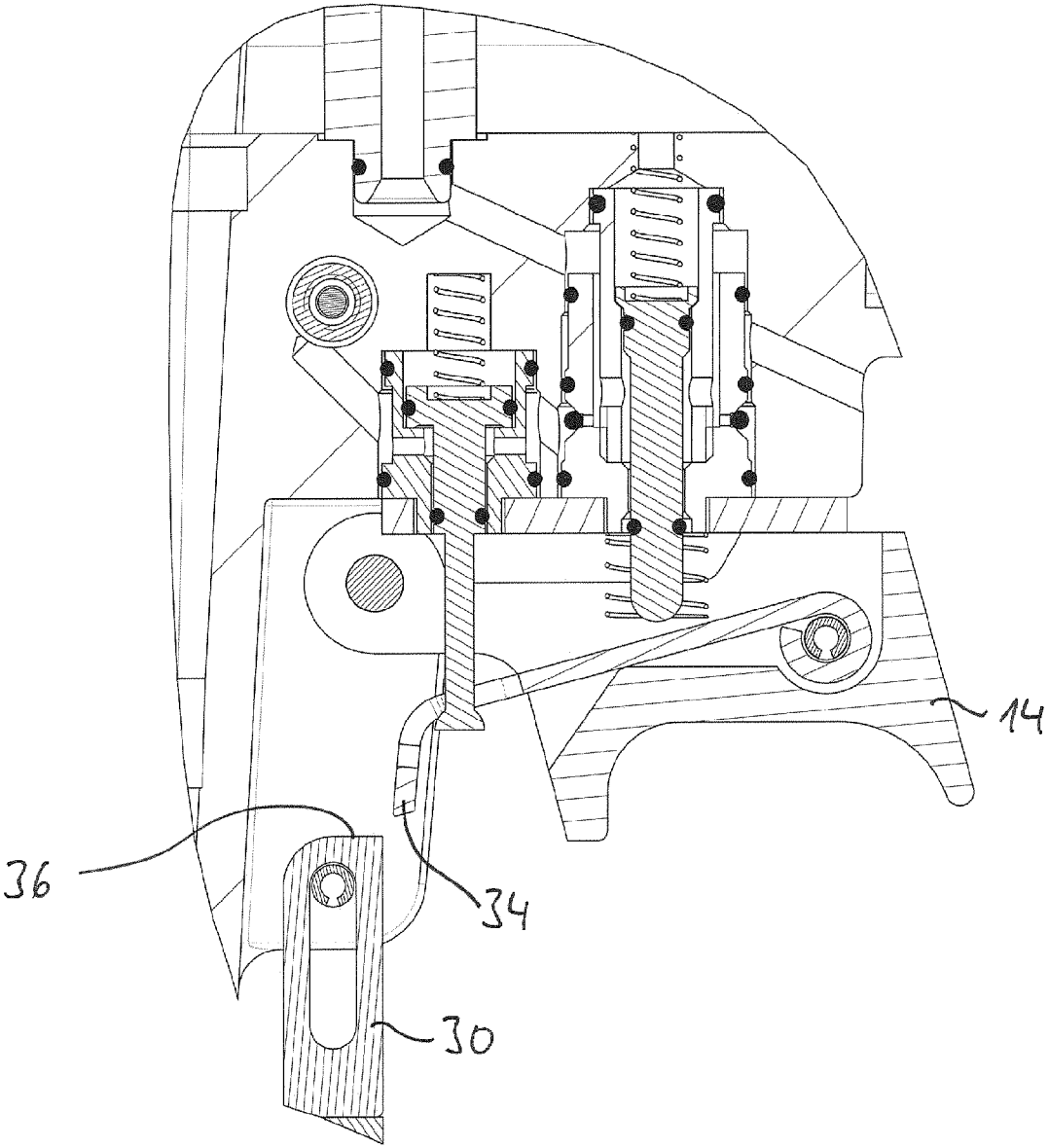
FIG. 13 shows the front end of the rocker at a lateral distance from the catch so that it is not grabbed by the catch in an upward movement of the slider.
Figure 14:
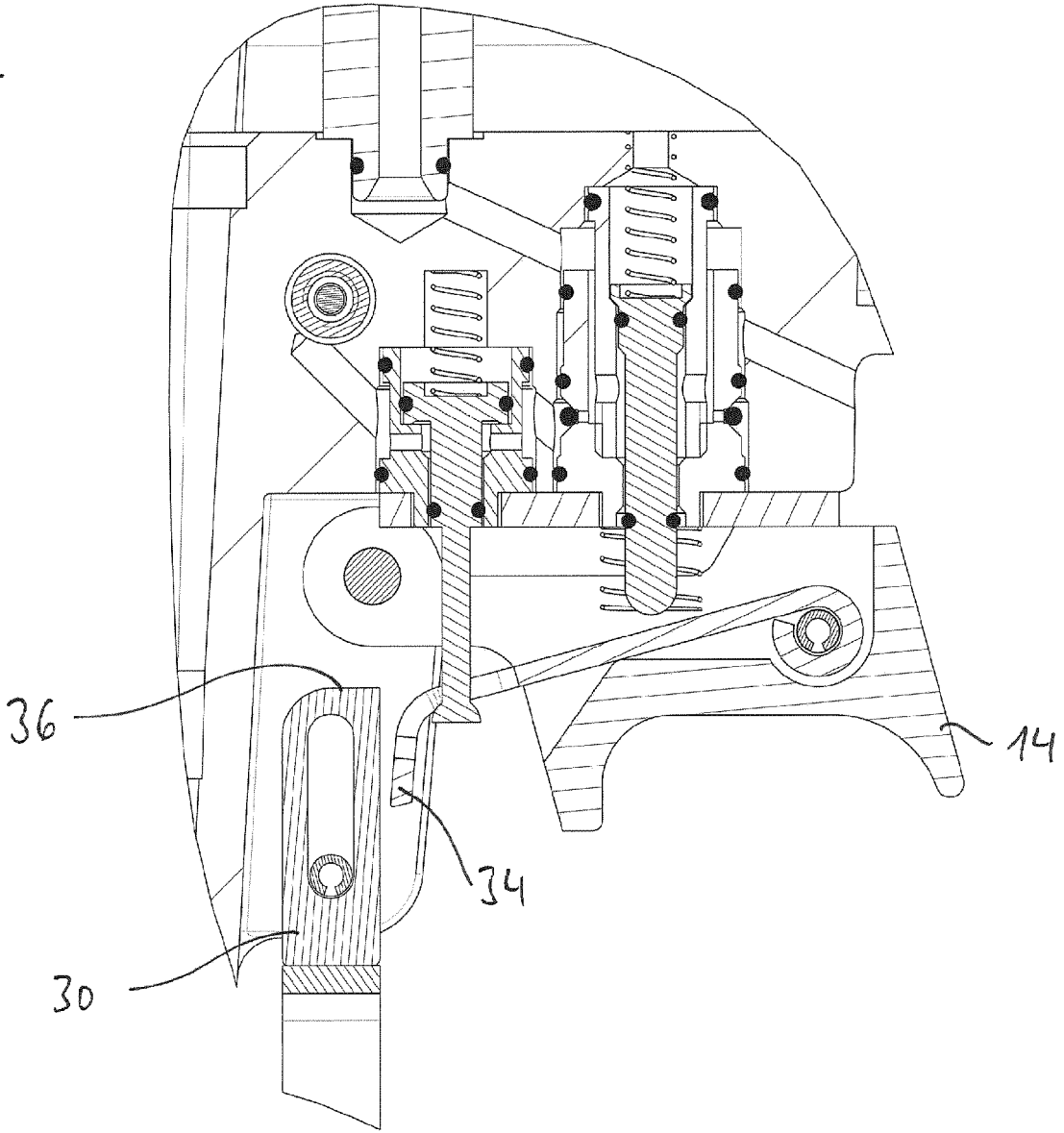
FIG. 14 shows the arrangement of FIG. 13 where the catch moves past the front end and no contact triggering occurs.

This is shown in FIG. 13. It can be seen that in this exemplary embodiment as well, the front end 34 of the rocker is at a lateral distance from the catch 36 so that it is not grabbed by the catch 36 in an upward movement of the slider 30. Instead, the catch 36 moves past the front end 34 on the side, and no contact triggering occurs even though the trigger 14 is still actuated. This is shown for the second exemplary embodiment in FIG. 14.

LIST OF REFERENCE NUMBERS USED

10 Pneumatic nailer
12 Handle
14 Trigger
16 Pivot shaft
18 Rocker
20 Switching surface
22 Control valve
24 Contact sensor
26 Aperture
28 Aperture tool
30 Slider
32 Slot
34 Front end
36 Catch
38 Pivot shaft
40 Top O-ring
42 Control pin
44 Radial hole
46 Seat
48 Magazine
50 Driving plunger
52 Working piston
54 Working cylinder
56 Main valve
58 Pilot valve
60 Bottom O-ring
62 Annular gap
64 Housing interior
66 Sleeve
68 Control cylinder
70 Annular gap
72 Compartment
74 Control volume
76 Spring
78 Throttle
80 Switching device
82 First control line
84 O-ring
86 Hole
88 Triangular groove
90 Radial hole
92 Spring
94 Control piston
96 Guide sleeve
98 Guide pin
100 Bottom O-ring
102 Spring
104 Middle O-ring
106 Top O-ring
110 Main control line
112 Radial hole
114 Compartment
116 Main valve actuator
118 O-ring
120 Spring
122 Annular surface
124 Control surface
126 Rear end
128 Opening
130 Head
132 Control piston
134 Piston rod
140 Bottom housing part
142 Housing cap

The invention claimed is:

1. A pneumatic nailer comprising:

a working piston connected to a driving plunger that is configured for driving in a fastener, wherein the working piston is contacted by compressed air when a driving process is triggered;

a triggering device comprising, a manually-operated trigger, a contact sensor, and a force-transmitting device configured to transmit forces from the manually-operated trigger and the contact sensor to a control pin of a control valve which must be actuated for triggering a driving process, wherein the pneumatic nailer can be operated in a contact triggering mode and in a single triggering mode, wherein in the contact triggering mode, the force-transmitting device is in a contact triggering position and the control valve is actuated by the force-transmitting device no matter in which order the manually-operated trigger and the contact sensor are actuated, wherein in the single triggering mode, the control valve is actuated by the force-transmitting device only if the contact sensor is actuated before the manually-operated trigger; and a switching device having a control piston guided in a control cylinder comprising a control volume, wherein the control is configured to move between a first position assigned to the single triggering mode and a second position assigned to the contact triggering mode, wherein when a driving process is triggered, the control valve changes a pressure in the control volume which causes the control piston to move into the second position, wherein the control piston is configured to move or hold the force-transmitting device in the contact triggering position, wherein the control piston is moved into the first position when a set pressure threshold in the control volume is undershot or exceeded.

2. The pneumatic nailer according to claim 1, wherein the set pressure threshold M the control volume is exceeded when the control volume is filled with air and the set pressure threshold of the control volume is undershot when the control volume is vented by the control valve when a driving process is triggered.

3. The pneumatic nailer according to claim 2, further comprising a check valve that is configured to one of: (1) fill the control volume with air; and (2) vent the air from the control volume.

4. The pneumatic nailer according to claim 2, wherein the control valve and the control piston are combined in a valve block.

5. The pneumatic nailer according to claim 4, further comprising a pneumatic connection between the control valve and the control volume, Wherein the pneumatic connection has an overall volume which is less than the control volume.

6. The pneumatic nailer according to claim 5, wherein the pneumatic connection is arranged within the valve block.

7. The pneumatic nailer according to claim 1, wherein the switching device further comprises a time control, and wherein the switching device is configured to move from the second position into the first position after expiration of a set time if the driving process is not triggered.

8. The pneumatic nailer according to claim 7, wherein the time control comprises a throttle that is connected to the control volume.

9. The pneumatic nailer according to claim 1, wherein the force-transmitting device further comprises a movably mounted force transmitting element comprising a switching surface configured to actuate the control valve, wherein the force transmitting element is arranged in the contact triggering position and is configured to be entrained a catch that is connected to the contact sensor to execute a movement in a triggering direction.

10. The pneumatic nailer according to claim 9, wherein the switching device is configured to limit a movement in the second position of the movably mounted force transmitting element contrary to the triggering direction.

11. The pneumatic nailer according to claim 9, wherein the movably mounted force transmitting element is a rocker pivotally mounted on a pivot shaft in the trigger and comprising the switching surface.

12. The pneumatic nailer according to claim 11, wherein the control piston comprises a piston rod configured to lie against a control surface of the rocker opposite the switching surface of the rocker with respect to a pivot shaft of the rocker when in the second position.

13. The pneumatic nailer according to claim 11, Wherein the control piston comprises a piston rod configured to be guided through an opening in the rocker and pull the rocker toward the piston rod.

14. The pneumatic nailer according to claim 1, wherein a size of the control volume is not more than 5% of a size of a working volume of a working cylinder in which the working piston is guided.

* * * * *